United States Patent [19]

Fister

[11] 3,938,067

[45] Feb. 10, 1976

[54] PROTECTOR FOR ELECTRIC CIRCUITS

[75] Inventor: Aloysius J. Fister, Overland, Mo.

[73] Assignee: McGraw-Edison Company, Elgin, Ill.

[22] Filed: June 28, 1974

[21] Appl. No.: 484,129

[52] U.S. Cl. ..... 337/159; 337/290; 337/295

[51] Int. Cl.[2] ..... H01H 85/04

[58] Field of Search ..... 337/158, 159, 160, 166, 337/186, 187, 273, 276, 280, 284, 166, 161, 290, 295

[56] References Cited

UNITED STATES PATENTS

| | | | |
|---|---|---|---|
| 2,665,348 | 1/1954 | Kozacka | 337/159 |
| 2,713,098 | 7/1955 | Swain | 337/161 |
| 2,734,111 | 2/1956 | Kozacka | 337/161 |
| 2,863,967 | 12/1958 | Swain | 337/276 X |
| 2,939,934 | 6/1960 | Kozacka | 337/159 |
| 3,513,424 | 5/1970 | Kozacka | 337/158 |
| 3,538,479 | 11/1970 | Fister | 337/161 |
| 3,714,613 | 1/1973 | Appleton | 337/159 X |

*Primary Examiner*—Harold Broome
*Assistant Examiner*—Fred E. Bell
*Attorney, Agent, or Firm*—Rogers, Ezell & Eilers

[57] ABSTRACT

A current-limiting, single-element, dual-function, electric fuse has a fusible element with at least one "weak spot" of very small cross section; and the temperature of that weak spot will exceed eighty percent of the melting temperature of the material of that fusible element when that electric fuse operates at its maximum continuous current carrying capacity. An appreciable amount of the heat, which the weak spot generates in response to a low but potentially-harmful overload, will be conducted to the inner surface of the housing for the electric fuse by the arc-quenching filler; and a substantial percent of that conducted heat will pass to, and be radiated by, the exposed outer surface of that housing. The conduction of heat to the inner surface of the housing is fostered by locating the weak spot closer to that inner surface than to either terminal of the electric fuse; and the passing of that heat to the exposed outer surface of that housing is fostered by making that housing of a material which has a thermal conductivity in excess of thirty thousandths of a calorie per square centimeter of cross section per centimeter of length per second of time per degree centigrade.

24 Claims, 10 Drawing Figures

PROTECTOR FOR ELECTRIC CIRCUITS

BACKGROUND OF THE INVENTION

Fuse clips, fuse clamps, bus bars, heat sinks, and other metal objects to which the terminals of electric fuses are secured are usually cooler than the weak spots of those electric fuses. Consequently, it is traditional to expect, and to count on, a gradient between the temperatures of the weak spot and of the terminals of an electric fuse; and that gradient fosters cooling of that weak spot by causing heat to flow to those relatively-cool terminals. However, because the fusible elements of current-limiting fuses are made thin, those fusible elements limit the rate at which heat can be caused to flow from the weak spots to the terminals of such electric fuses.

Some electric fuses have fusible elements which perform only one function, whereas other electric fuses have fusible elements which perform dual functions. One example of an electric fuse that has a fusible element which performs only one function is an electric fuse that is connected in series relation with a circuit breaker; and the only function to be performed by the fusible element of such an electric fuse is to open the circuit on a heavy overload or short circuit. Another example of an electric fuse that has a fusible element which performs only one function is an electric fuse which has a spring-biased connector or a large mass of solder that can respond to a prolonged low overload to open the circuit; and the only function to be performed by the fusible element of such an electric fuse is to open the circuit on a heavy overload or short circuit. One example of an electric fuse that has a fusible element which performs a dual function is a renewable electric fuse that has a fusible element which is able to open the circuit in response to a prolonged low overload or to a heavy overload or short circuit. Another example of an electric fuse that has a fusible element which performs a dual function is an electric fuse that has a silver or copper fusible element with a mass of tin riveted or bonded to it. An electric fuse which has a spring-biased connector or a large mass of solder that can respond to a prolonged low overload to open the circuit is referred to as a dual-element electric fuse; and, similary, an electric fuse that has a silver or copper fusible element with a mass of tin riveted or bonded to it is referred to as a dual-element electric fuse.

Summary of the Invention: The present invention provides a current-limiting, single-element, dual-function, electric fuse which has a fusible element with at least one weak spot; and that weak spot is closer to the inner surface of the housing of that electric fuse than it is to either terminal of that electric fuse. That weak spot is directly contacted by arc-quenching filler which also directly contacts, and which can transfer heat to, that inner surface. The major portion of the outer surface of the housing of the electric fuse is exposed; and that housing is made from a material which has a thermal conductivity in excess of thirty thousandths of a calorie per square centimeter of cross section per centimeter of length per second of time per degree centigrade. As a result, that arc-quenching material and that housing can rapidly dissipate heat which is generated by the weak spot, and can thereby enable that weak spot to be made with a very small cross section. That weak spot will have a temperature in excess of eighty percent of the melting temperature of the material of that fusible element when the electric fuse is operating at its maximum continuous current carrying capacity; and hence that weak spot can rapidly respond to a low but potentially-harmful overload to open the circuit. It is, therefore, an object of the present invention to provide a current-limiting, single-element, dual-function, electric fuse which has a fusible element with at least one weak spot of very small cross section, and which has that weak spot operating at temperatures in excess of eighty percent of the melting temperature of that fusible element when the electric fuse is operating at its maximum continuous current carrying capacity.

The present invention disposes the weak spot of the electric fuse so the radial distance between that weak spot and the adjacent inner surface of the housing for that electric fuse is less than 64 millimeters, and so the axial distance between that weak spot and either terminal of that electric fuse is greater than eighty millimeters. Further, the present invention disposes the arc-quenching filler in direct contact with the weak spot and with the inner surface of the housing for the electric fuse. As a result, appreciable amounts of the heat which is generated by the small cross section weak spot will pass to, and be radiated by, the exposed outer surface of the housing. It is, therefore, an object of the present invention to dispose the weak spot of a current-limiting, single-element, dual-function, electric fuse so the radial distance between the weak spot and the adjacent inner surface of the housing for that electric fuse is less than 64 millimeters and so the axial distance between that weak spot and either terminal of that electric fuse is greater than 80 millimeters.

Other and further objects and advantages of the present invention should become apparent from an examination of the drawing and accompanying description.

In the drawing and accompanying description several preferred embodiments of the present invention are shown and described but it is to be understood that the drawing and accompanying description are for the purpose of illustration only and do not limit the invention and that the invention will be defined by the appended claims.

DETAILED DESCRIPTION OF THE PREFERRED EMBODIMENTS

Referring to FIGS. 1–4 in detail, the numeral 10 generally denotes an electric fuse which is made in accordance with the principles and teachings of the present invention. That electric fuse has a cylindrical housing 12 of inorganic ceramic material which has a thermal conductivity greater than thirty thousandths of a calorie per square centimeter of cross section per centimeter of length per second of time per degree centigrade. Some inorganic ceramic materials which have such a thermal conductivity are aluminum oxide, beryllium oxide and boron nitride. The housing has annular grooves 14 adjacent the opposite ends thereof, and it has an axially-extending passage 18 therein. In the preferred embodiment of FIGS. 1–4, the outer diameter of the housing 12 is one and nine hundred and five thousandths of a centimeter, the length of that housing is five and eight hundredths of a centimeter, and the diameter of the passage 18 is six hundred and eighty-six thousandths of a centimeter. Where the electric fuse of FIGS. 1–4 is to be used on a one hundred and 25 volt circuit or on a 250 volt circuit, that housing will be one and nine-hundred and five-thousandths of a centimeter long. Where that electric fuse is to be used on a 500 volt circuit, that housing will be three and eighty-one hundredths centimeters long; and where that electric fuse is to be used on a seven hundred volt circuit, that housing will be five and eight hundredths centimeters long.

Figure 4:
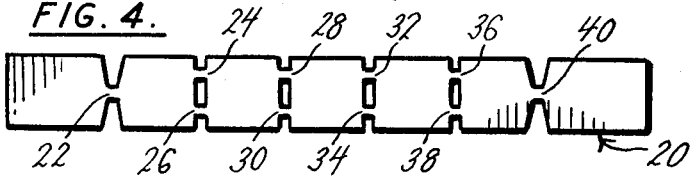
FIG. 4 is a plan view, on the scale of FIG. 2, of the fusible element of the electric fuse of FIG. 1.

The numeral 20 generally denotes the fusible element for the electric fuse 10; and that fusible element is shown in detail by FIG. 4. That fusible element has weak spots 22 and 40 which are defined by pairs of frusto-triangular notches in the elongated sides of that fusible element; and those weak spots are spaced away from the ends of that fusible element. In addition, the fusible element 20 has pairs of weak spots 24 and 26, 28 and 30, 32 and 34, and 36 and 38. Each of those pairs of weak spots is formed by a rectangular slot which is located between, and which is in register with, two shallow rectangular notches in the elongated sides of that fusible element. The fusible element 20 could be made of silver or of copper; but, in all preferred embodiments of the present invention, that fusible element is made of silver. The fusible element 20 is five hundred and forty-six thousandths of a centimeter wide; and, where the electric fuse 10 is to have a rating of one hundred amperes, that fusible element will have a thickness of thirteen thousandths of a centimeter. Where that electric fuse is to have a rating of two hundred amperes, that fusible element will have a thickness of twenty thousandths of a centimeter. Each weak spot 22 and 40 is thirty-eight thousandths of a centimeter wide; and the axial dimension of its inner end is thirty-eight thousandths of a centimeter. Each of the weak spots 24, 26, 28, 30, 32, 34, 36 and 38 is forty-seven thousandths of a centimeter wide; and the axial dimension of each of those weak spots is fifty-three thousandths of a centimeter.

The electric fuse 10 does not have a connector which is normally held intermediate the confronting ends of a fusible element and of a heat-absorbing member by solder and which can be moved away from those confronting ends whenever a prolonged low overload softens that solder. Also, that electric fuse does not have a large mass of solder which normally interconnects the confronting ends of fusible elements and which can respond to a prolonged low overload to melt and flow away from those confronting ends. Further, that electric fuse does not have a mass of tin or alloying material which is riveted, bonded, or otherwise secured to the fusible element of that electric fuse and which can respond to a prolonged low overload to alloy with the material of that fusible element. All of this means that the fusible element 20 of the electric fuse 10 is the sole circuit-interrupting element of that electric fuse; and hence that fusible element must be capable of carrying its rated current continuously, must be capable of responding to a potentially-harmful low overload to rise to its melting temperature, and must be capable of responding to a short circuit or heavy overload to rise to its melting temperature. Because the fusible element 20 is the sole circuit-interrupting element of the electric fuse 10, that electric fuse is a single-element, dual-function, electric fuse rather than a dual element, electric fuse or a single-element, single-function, electric fuse.

The numeral 42 denotes a ferrule-like closure which is telescoped over the left-hand end of the housing 12; and that closure has the rim thereof extending into the left-hand annular groove 14. The numeral 44 denotes a similar ferrule-like closure which is telescoped over the right-hand end of the housing 12, and that closure has the rim thereof extending into the right-hand annular groove 14. The rims of the ferrule-like closures 42 and 44 are caused to "cold flow" into those annular grooves and thereby lock those ferrule-like closures solidly onto that housing. If desired, yieldable annuli of the type disclosed in my U.S. Pat. No. 3,644,861 could be disposed in the annular grooves 14 prior to the time the rims of the ferrule-like closures 42 and 44 were forced to cold-flow into those annular grooves. The ferrule-like closures 42 and 44 are electrically connected to the ends of the fusible element 20 by solder; and, in the embodiment of FIGS. 1–4, that solder has a melting temperature of three hundred and nine degrees centigrade.

The ferrule-like closures 42 and 44 constitute intermediate terminals for the electric fuse 10; and one of those ferrule-like closures is telescoped over the appropriate end of the housing 12 and has its rim forced into the appropriate annular groove 14. Thereafter, that electric fuse is set with its axis vertical and with that ferrule-like closure at the lower end thereof. Thereupon, a piece of flux-containing solder or a piece of solder plus some flux are dropped downwardly through the passsage 18 and permitted to come to rest on the exposed portion of the inner surface of that ferrule-like closure. Heat is then applied to that ferrule-like closure to cause that solder to electrically bond the lower end of the fusible element 20 to the exposed inner surface of that ferrule-like closure. Subsequently, a quantity of arc-quenching filler 45, such as sand, is introduced into the passage 20. That arc-quenching filler will directly contact each of the weak spots 22, 24, 26, 28, 30, 32, 34, 36, 38 and 40, and also will directly contact the inner surface of the passage 18. Sufficient arc-quenching filler 45 will be introduced into the passage 18 to substantially fill that passage. At such time, a piece of flux-containing solder or a piece of solder plus some flux will be introduced into the upper end of the passage 18, the second ferrule-like closure will be telescoped downwardly over the upper end of the housing 12, and the rim of that ferrule-like closure will be forced into the other annular groove 14. Thereafter, the electric fuse 10 will be inverted, and heat will be applied to that second ferrule-like closure. The resulting melting of the solder will electrically bond the other end of the fusible element 20 to the exposed inner surface of that second ferrule-like closure.

The numeral 46 generally denotes a terminal which has a cylindrical portion 48, a blade portion 50, an annular rim 52, and an opening 54. That rim projects from that face of the cylindrical portion 48 which is opposite to the blade portion 50; and the opening 54 is in that blade portion. The terminal 46 is dimensioned so the end wall of the ferrule-like closure 42 can be telescoped inwardly of the rim 52 and can abut the recessed right-hand face of the cylindrical portion 48 of that terminal. Solder is used to electrically bond and mechanically connect the terminal 46 to the ferrule-like closure 42; and that solder will be applied while the axis of the housing 12 is vertical and that terminal underlies that ferrule-like closure. The rim 52 acts as a dam to confine the solder while that solder is being melted and is being permitted to alloy with that terminal and ferrule-like closure.

The numeral 56 generally denotes a terminal which can be identical to the terminal 46; and the former terminal has a cylindrical portion 58, a blade portion 60, a rim 62, and an opening 64. The rim 62 extends from that face of the cylindrical portion 58 which is opposite to the blade portion 60, and the opening 64 is in that blade portion. Solder is used to electrically bond and mechanically connect that terminal to the ferrule-like closure 44; and the rim 62 will act as a dam to confine the solder while that solder is being melted and is being permitted to alloy with that terminal and ferrule-like closure.

The solder which is used to electrically bond and mechanically connect the ends of the fusible element 20 to the exposed inner surfaces of the ferrule-like closures 42 and 44 has a melting temperature of about 309° centigrade, and hence is known as high temperature solder. The solder which is used to electrically bond and mechanically connect the terminals 46 and 56, respectively, to the outer surfaces of the end walls of the ferrule-like closures 42 and 44 also has a melting temperature of about 309° centigrade, and hence is known as high temperature solder. At the time the terminal 46 is being soldered to the outer surface of the end wall of the ferrule-like closure 42, the solder which is used to electrically bond and mechanically connect the fusible element 20 to that ferrule-like closure will melt; but that solder will re-solidify as that terminal and that ferrule-like closure are permitted to cool. Similarly, at the time the terminal 56 is being soldered to the outer surface of the end wall of the ferrule-like closure 44, the solder which is used to electrically bond and mechanically connect the fusible element 20 to that ferrule-like closure will melt; but that solder will re-solidify as that terminal and that ferrule-like closure are permitted to cool.

Each of the weak spots 22, 24, 26, 28, 30, 32, 34, 36, 38 and 40 is spaced away from the inner surface of the passage 18; but the longest radial distance between any part of any one of those weak spots and the adjacent surface of the passage 18 is shorter than the longest axial distance between that part of that one weak spot and the inner surface of the adjacent ferrule-like closure. Also, the cross sectional area of the path which the arc-extinguishing filler 45 provides for heat, which seeks to flow from that part of that one weak spot to the inner surface of the passage 18, is much greater than the cross sectional area of that portion of the fusible element 20 which connects that one weak spot to the adjacent ferrule-like closure. Consequently, although the metal of the fusible element 20 is a better thermal conductor than is the material of the arc-extinguishing material 45, that arc-quenching material can absorb very appreciable amounts of heat from that one weak spot and can then conduct most of those amounts of heat to the inner surface of the passage 18.

In the preferred embodiment of FIGS. 1–4, the longest radial distance between the weak spot 22 or the weak spot 40 and the inner surface of the passage 18 is measured at right angles to the plane of the fusible element 20; and, when that fusible element is at the geometric axis of that passage and when the electric fuse 10 is rated at one hundred amperes, that radial distance is three hundred and thirty-six thousandths of a centimeter. Where that electric fuse is rated at two hundred amperes, that radial distance is three hundred and thirty-three thousandths of a centimeter. The longest radial distance between the weak spot 22 or the weak spot 40 and the inner surface of the passage 18, as measured in the plane of that fusible element, is three hundred and twenty-four thousandths of a centimeter. The shortest axial distance between the weak spot 22 or the weak spot 40 and the inner surface of the end wall of the adjacent ferrule-like closure is eight-tenths of a centimeter.

The high thermal conductivity of the material, from which the housing 12 is made, enables substantial amounts of the heat, which is absorbed by the inner surface of the passage 18, to readily pass to the outer surface of that housing. That heat will radiate into the surrounding cooling medium, which usually will be air; and it will be noted that the major portion of the outer surface of the housing 12 is exposed. Consequently, the outer surface of the housing 12 can, and will, radiate substantial amounts of heat.

Whenever current flows through the electric fuse 10, all of the weak spots of the fusible element 20 will generate heat; and the amount of heat which is generated by each of those weak spots will be proportional to the product of the square of that current and the resistance of that weak spot. Because the cross section of each of the weak spots 22 and 40 is much smaller than the combined cross sections of each of the pairs of weak spots 24 and 26, 28 and 30, 32 and 34, and 36 and 38, each weak spot 22 and 40 will generate more heat than any of those pairs of weak spots will generate. When the fusible element 20 operates at its maximum continuous current carrying capacity, each of the weak spots 22 and 40 will attain a temperature in excess of eighty percent of the melting temperature of the material used in that fusible element. Specifically, where that fusible element is made from silver, each of the weak spots 22 and 40 will attain a temperature in excess of 768° centigrade when the electric fuse 10 is operated at its maximum continuous current carrying capacity; and where that fusible element is made from copper each of those weak spots will attain a temperature in excess of 866° centigrade.

In determining the maximum continuous current carrying capacity of any given electric fuse, a current is selected which is so low that the electric fuse can carry that current indefinitely without opening the circuit. The temperatures of the terminals and of the longitudinal midpoint of the exterior of the housing are checked and recorded at intervals—none of which is shorter than five minutes—while that current flows through that electric fuse; and that current level is maintained until all of those temperatures have stabilized. Those temperatures are considered to have stabilized when all of them remain un-changed during three consecutive temperature checks at such intervals. Thereafter, the value of the current flowing through the electric fuse is increased by a fixed increment—usually about five percent of the original current value—and the three temperatures are permitted to stabilize. The value of the current is repeatedly increased by that fixed increment, and the temperatures are repeatedly permitted to stabilize, until a current level is reached which causes the electric fuse to open the circuit. The immediately-preceding current level, at which the three temperatures stabilized, is considered to be the maximum continuous current carrying capacity of that electric fuse.

As long as the value of the current flowing through the electric fuse 10 is at or below the maximum continuous current carrying capacity of that electric fuse, the temperature of each of the weak spots 22, 24, 26, 28, 30, 32, 34, 36, 38 and 40 will be below the melting temperature of the material of the fusible element 20; because most of the heat which is generated by the weak spots 22, 24, 26, 28, 30, 32, 34, 36, 38 and 40 will be conducted to and dissipated by the housing 12 and the terminals 46 and 56. In that regard, it should be noted that the high thermal conductivity of the material of the housing 12 limits the gradient between the temperature at the inner surface of the passage 18 and the temperature at the outer surface of that housing to less than 200° centigrade. Such a low temperature gradient is important; because it makes certain that the inner surface of the passage 18 will be cooler than, and hence can readily absorb heat from, the various weak spots 22, 24, 26, 28, 30 32, 34, 36, 38 and 40. As a result, the electric fuse 10 can carry any and all current values, at or below the maximum continuous current carrying capacity thereof, indefinitely.

Where the electric fuse 10 is used to protect a solid state diode or other solid state device, it will be desirable to have the maximum continuous current carrying capacity of that electric fuse be close to 105 percent of the rated current of that solid state device. Where that is done, that electric fuse will be able to continuously carry all values of current up to and including a value equal to 105 percent of the rated current of that solid state device; and yet that electric fuse will promptly open the circuit if the current rises to 110 percent of the rated current of that solid state device. Specifically, when the current level is 105 percent of the rated current of the solid state device, the electric fuse 10 will be operating at its maximum continuous current carrying capacity; and hence the temperature of the material of the weak spot 22 or of the weak spot 40 will be in excess of eighty percent of the melting temperature of that material. That temperature will quickly rise to the melting temperature of the material of the fusible element 20 when the current rises to 110 percent of the rated current of the solid state device; and the resulting rapid opening of the circuit will protect that solid state device. All of this means that the present invention enables the electric fuse 10 to continuously carry all safe levels of current, but enables even very low potentially-harmful overloads to promptly raise the temperature of one of the weak spots of the fusible element 20 to the melting temperature of that fusible element. In this way the electric fuse 10 can provide a desirably high degree of protection for solid state devices.

In the event a heavy overload or short circuit were to occur, the temperatures of several, and possibly all, of the weak spots 22, 24, 26, 28, 30, 32, 34, 36, 38 and 40 would, almost instantaneously, rise to the melting temperature of the fusible element 20. The resulting rapid opening of the circuit would protect that circuit and any un-shorted components thereof.

It thus should be apparent that the fusible element 20 performs the dual functions of protecting the circuit against very low but potentially-harmful overloads and of protecting that circuit against heavy overloads and short circuits. This means that the electric fuse 10 is a current-limiting, single-element, dual-function, electric fuse.

Figure 5:
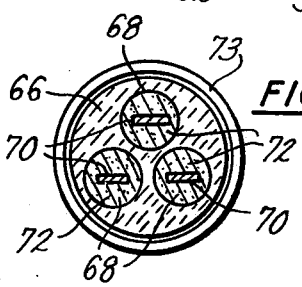
FIG. 5 is a sectional view, on the scale of FIG. 1, through an embodiment of electric fuse which has a housing with three passages therein.

Referring particularly to FIG. 5, the numeral 66 denotes a housing which has three passages 68 therein. The diameter of that housing is two and fifty-four hundredths of a centimeter, and the diameter of each of those passages is six hundred and eighty-six thousandths of a centimeter. The length of the housing 66 will be determined by the voltage of the circuit in which the electric fuse of FIG. 5 is connected; all as explained hereinbefore in connection with electric fuse 10 of FIGS. 1–4. The numeral 70 denotes fusible elements which are disposed within the passages 68; and the numeral 72 denotes arc-quenching filler within those passages. Those fusible elements can be very similar to the fusible element 20 of FIGS. 1–4; and that arc-quenching filler can be identical to the arc-quenching filler 45 of FIGS. 1–4. The numeral 73 in FIG. 5 denotes the rim of one of the terminals of the electric fuse; and that rim can be very similar to the rim 52 in FIGS. 1–4. Although FIG. 5. shows a fusible element 70 in each of the passages 68 in the housing 66, not all of those passages need be equipped with a fusible element and arc-quenching filler. By providing the housing 66 with the three passages 68, the present invention makes it a simple matter to produce specifically-different electric fuses that have the same size but that have specifically-different ratings. All that need be done is vary the number of passages 68 that are equipped with fusible elements 70.

Figure 6:
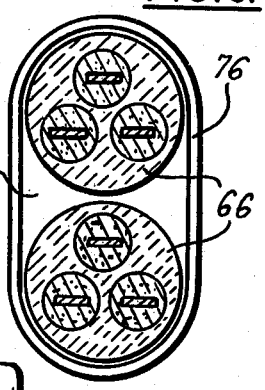
FIG. 6 is a sectional view, on the scale of FIG. 1, through an embodiment of electric fuse which has two housings and which has three passages in each of those housings.

Referring particularly to FIG. 6, the numeral 74 denotes a terminal which has parallel sides and rounded ends; and that terminal has a rim 76 which extends from one surface of that terminal. The numeral 66 denotes two housings which preferably will be identical to the housing 66 of FIG. 5. Although fusible elements are shown in each of the three passages in each of the housings 66 in FIG. 6, not all of those passsages need be equipped with a fusible element and arc-quenching filler. By providing the two housings 66, the present invention makes it a simple matter to produce specifically-different electric fuses that have the same size but that have specifically-different ratings. All that need be done is vary the number of passages that are equipped with fusible elements.

Figure 7:
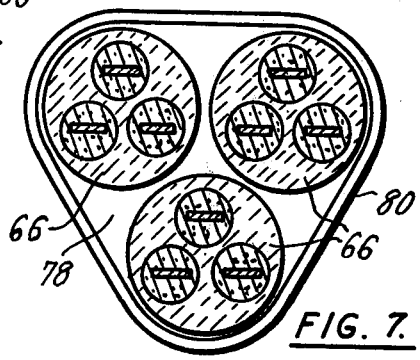
FIG. 7 is a sectional view, on the scale of FIG. 1, through an embodiment of electric fuse which has three housings and which has three passages in each of those housings.

Referring particularly to FIG. 7, the numeral 78 denotes a terminal which is generally triangular in end elevation but which has convex, rather than sharp, corners. The numeral 80 denotes a rim which extends from one face of that terminal. The numeral 66 denotes three housings which preferably are identical to the housing 66 of FIG. 5. Although FIG. 7 shows a fusible element in each passage of each of the housings 66, not all of those passages need be equipped with a fusible element and arc-quenching filler. By providing the three housings 66, the present invention makes it a simple matter to produce specifically-different electric fuses that have the same size but that have specifically-different ratings. All that need be done is vary the number of passages that are equipped with fusible elements.

Figure 1:
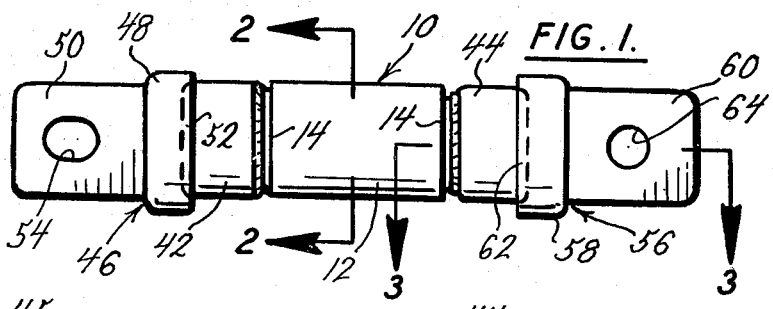
FIG. 1 is a plan view of one preferred embodiment of electric fuse that is made in accordance with the principles and teachings of the present invention.
Figure 2:
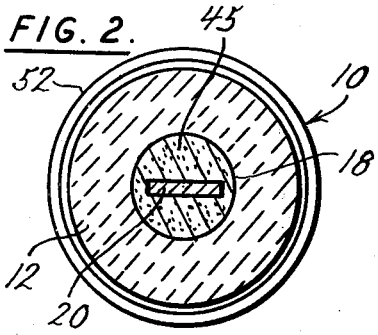
FIG. 2 is a sectional view, on a larger scale, through the electric fuse of FIG. 1, and it is taken along the plane indicated by the line 2—2 in FIG. 1.
Figure 3:
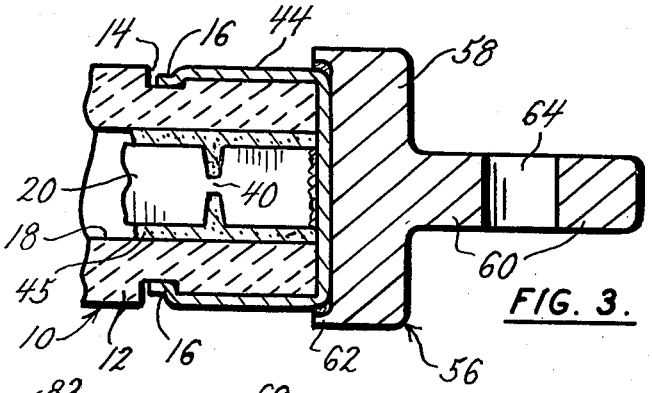
FIG. 3 is another sectional view, on the scale of FIG. 2, through the electric fuse of FIG. 1, and it is taken along the plane indicated by the line 3—3 in FIG. 1.
Figure 9:
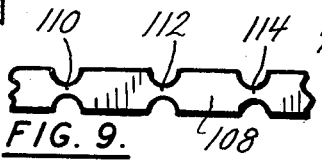
FIG. 9 is a broken view of the fusible element for the electric fuse of FIG. 8.
Figure 8:
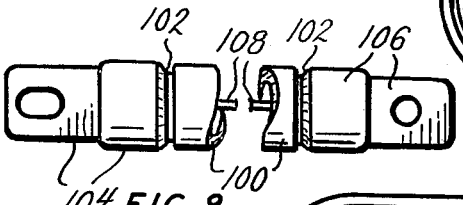
FIG. 8 is a broken plan view of an embodiment of electric fuse which is generally similar to the embodiment of FIGS. 1–4.

Referring particularly to FIGS. 8 and 9, the numeral 100 generally denotes a housing which is identical to the housing 12 of FIGS. 1–3; and the annular grooves 102 adjacent the opposite ends of that housing are identical to the annular grooves 14 of FIGS. 1 and 3. The numeral 104 denotes a terminal which has a ferrule-like portion and a blade portion; and that ferrule-like portion can be identical to the ferrule-like closure 42 of FIG. 1, and that blade portion can be similar to the blade portion 50 of the terminal 46. The rim of the ferrule-like portion of the terminal 104 extends into the left-hand annular groove 102 to mechanically secure that terminal to the housing 100. The numeral 106 denotes a terminal which is identical to the terminal 104; and the rim of the ferrule-like portion of terminal 106 extends into the right-hand annular groove 102 to mechanically secure that terminal to the housing 100.

The numeral 108 in FIG. 9 generally denotes a fusible element which can be used in the electric fuse of FIG. 8. That fusible element could be made essentialy of silver or of copper; but, in the embodiment of FIG. 9, it is made of silver. Weak spots 110, 112, and 114 are shown in the fusible element 108; and each of those weak spots is defined by a pair of semicircular notches which extend inwardly from the elongated edges of that fusible element. Although only three weak spots are shown in FIG. 9, one preferred embodiment of the electric fuse of FIG. 8 has a fusible element with five weak spots therein. That fusible element has a width of three hundred and eighteen thousandths of a centimeter, has a thickness of thirteen thousandths of a centimeter, and has the longitudinal centers of the centermost weak spots thereof spaced apart by eight-tenths of a centimeter. The distance between the longitudinal center of each endmost weak spot and the adjacent weak spots is eight hundred and thirteen thousandths of a centimeter. The radii of the semicircular notches are one hundred and twelve thousandths of a centimeter; and hence the width of each weak spot is ninety-four thousandths of a centimeter. The ends of the fusible element 108 are soldered to the exposed inner surfaces of the ferrule-like portions of the terminals 104 and 106 by high temperature solder; and arc-quenching filler surrounds that fusible element. Each of the endmost weak spots of the fusible element 108 is spaced from the exposed inner surface of the adjacent terminal by a distance of eight hundred and thirteen thousandths of a centimeter. Such a distance is more than twice the maximum distance of three hundred and thirty-six thousandths of a centimeter which will lie between the inner surface of the passage in the housing 100 and any of the weak spots of the fusible element 108 when that fusible element lies on the geometric axis of that passage.

Whenever current flows through the electric fuse of FIG. 8, all of the weak spots of the fusible element 108 will generate heat; and the amount of heat which is generated by each of those weak spots will be proportional to the product of the square of that current and the electrical resistance of that weak spot. Because some of the heat generated by the endmost weak spots of the fusible element 108 will be conducted to the terminals 104 and 106, the centermost weak spot or weak spots will tend to be hotter than those endmost weak spots. The resulting relatively-higher electrical resistance of the centermost weak spot or weak spots will cause that weak spot or those weak spots to generate more heat than the endmost weak spots will generate; and hence the temperatures of the centermost weak spot or weak spots will be higher than those of the endmost weak spots. When the electric fuse of FIG. 8 operates at its maximum continuous current carrying capacity, each of the centermost weak spots of the fusible element 108 will attain a temperature in excess of eigthy percent of the melting temperature of the material used in that fusible element. Specifically, where that fusible element is made from silver, each of the centermost weak spots will attain a temperature in excess of 768° centigrade when the electric fuse 100 is operated at its maximum continuous current carrying capacity; and where that fusible element is made from copper each of those weak spots will attain a temperature in excess of 866° centigrade. As long as the value of the current flowing through the electric fuse 100 is at or below the maximum continuous current carrying capacity of that electric fuse, the temperature of each of the centermost weak spots will be below the melting temperature of the material of the fusible element 100; because most of the heat which is generated by the various weak spots of that fusible element will be conducted to and dissipated by the housing 100 and the terminals 104 and 106. In that regard, it should be noted that the high thermal conductivity of the material of the housing 100 limits the gradient between the temperature at the inner surface of the passage in the housing 100 and the temperature at the outer surface of that housing to less than 200° centigrade. Such a low temperature gradient is important; because it makes certain that the inner surface of the passage in the housing 100 will be cooler than, and hence can readily absorb heat from all of the weak spots of the fusible element 108. As a result, the electric fuse of FIG. 8 can carry any and all current values, at or below the maximum continuous current carrying capacity thereof, indefinitely.

Where the electric fuse of FIG. 8 is used to protect a solid state diode or other solid state device, it will be desirable to have the maximum continuous current carrying capacity of that electric fuse be close to one hundred and five percent of the rated current of that solid state device. Where that is done, that electric fuse will be able to continuously carry all values of current up to and including a value equal to 105 percent of the rated current of that solid state device; and yet that electric fuse will promptly open the circuit if the current rises to 110 percent of the rated current of that solid state device. Specifically, when the current level is 105 percent of the rated current of the solid state device, the electric fuse of FIG. 8 will be operating at its maximum continuous current carrying capacity, and hence the temperature of the material of the centermost weak spots will be in excess of eighty percent of the melting temperature of the fusible element 108. That temperature will quickly rise to the melting temperature of the material of that fusible element when the current rises to one hundred and ten percent of the rated current of the solid state device; and the resulting opening of the circuit will protect that solid state device. All of this means that the present invention enables the electric fuse of FIG. 8 to continuously carry all safe levels of current, but enables even very low but potentially-harmful overloads to promptly raise the temperature of one of the centermost weak spots of the fusible element 108 to the melting temperature of that fusible element. In this way the electric fuse of FIG. 8 can provide a desirably high degree of protection for solid state devices.

In the event a heavy overload or short circuit were to occur, the temperatures of several, and possibly all, of the weak spots of the fusible element 108 would, almost instantaneously, rise to the melting temperature of that fusible element. The resulting rapid opening of the circuit would protect that circuit and any unshorted components thereof.

It thus should be apparent that the fusible element 108 performs the dual functions of protecting the circuit against very low but potentially-harmful overloads and of protecting that circuit against heavy overloads and short circuits. This means that the electric fuse of FIG. 8 is a current-limiting, single-element, dual-function, electric fuse.

The electric fuses of the present invention are able to open on very low but potentially-harmful overloads because the temperatures of the weak spots of the fusible elements thereof are in excess of eighty percent of the melting temperatures of those fusible elements when the currents flowing through those electric fuses are about 105 percent of the ratings of the loads protected by those electric fuses. Moreover, those electric fuses do not experience thermal or other degradation when they are operated continuously or intermittently on loads which make the temperatures of the weak spots exceed 80 percent of the melting temperatures of the fusible elements of those electric fuses; and no ordinary single-element, dual-function electric fuse can so do. To illustrate that fact, two electric fuses were made as shown in FIGS. 8 and 9; and those fuses were identical except that one of them had the housing thereof made of glass melamine whereas the other had the housing thereof made of aluminum oxide. Thermocouples were attached to the longitudinal centers of the outer surface of those housings, further thermocouples were attached to points on the inner surfaces of the passages in those housings, and additional thermocouples were attached to the terminals of those electric fuses. The numbers and locations of those thermocouples are set forth in the following chart:

| Thermocouple Number | Location of Thermocouple |
|---|---|
| 1 | At inner surface of passage of aluminum oxide housing |
| 2 | Longitudinal center of outer surface of aluminum oxide housing |
| 3 | Terminal at one end of aluminum oxide housing |
| 4 | Terminal at other end of aluminum oxide housing |
| 5 | At inner surface of passage of glass melamine housing |
| 6 | Longitudinal center of outer surface of glass melamine housing |
| 7 | Terminal at one end of glass melamine housing |
| 8 | Terminal at other end of glass melamine housing. |

Those electric fuses were connected in series relation so the exact same current would pass through both of them at any given instant; and each selected value of current was maintained until at least one of the electric fuses attained thermal equilibrium. The selected values of current, the temperatures sensed by the thermocouples, and the effects upon the electric fuses are set forth in the following chart:

| Values of Current In amperes | Centigrade Temperatures Sensed By Thermocouples 1 | 2 | 3 | 4 | 5 | 6 | 7 | 8 |
|---|---|---|---|---|---|---|---|---|
| 55 | 143 | 101 | 110 | 113 | 342 | 113 | 169 | 115 |
| 60 | 195 | 131 | 150 | 135 | 500* | 148 | 227 | 169 |
| 65 | 232 | 144 | 174 | 151 | Blew immediately | | | |
| 70 | 286[1] | 171 | 206 | 177 | | | | |

*At the time the temperatures sensed by thermocouples 1, 2, 3 and 4 became stabilized on sixty amperes, the temperature sensed by thermocouple 5 continued to rise — indicating a charring or burning of the inner surface of the passage in the glass melamine housing.

[1]Blew twenty-seven minutes after value of current was increased to seventy amperes.

The foregoing chart shows that the electric fuse of FIG. 8 has a still-air maximum continuous current carrying capacity of 65 amperes when it has an aluminum oxide housing, and has a still-air maximum continuous current carrying capacity of only 55 amperes when it has a glass melamine housing. Further, that chart shows that the thermal conductivity of the aluminum oxide housing keeps the temperature at the inner surface of the passage in the electric fuse of FIG. 8 below 350°C. when that electric fuse is operated at its maximum continuous current carrying capacity, whereas the temperature at the inner surface of the passage in the electric fuse with the glass melamine housing is greater than 350°C. when that electric fuse is operated at its maximum continuous current carrying capacity.

Also, that chart shows that the thermal conductivity of the aluminum oxide housing keeps the temperature at the inner surface of the passage in the electric fuse of FIG. 8 below 350°C. when the temperatures of the weak spots are caused by a prolonged low overload to reach 960°C., whereas the temperature at the inner surface of the passage in the electric fuse with the glass melamine housing is 500°C. when the temperatures of the weak spots are caused by a prolonged low overload to reach 960°C. In addition, that chart shows that the thermal conductivity of the aluminum oxide housing keeps the gradient between the temperature at the inner surface of the passage and the temperature at the outer surface of the housing less than 200°C. at all times, whereas the gradient between the temperature at the inner surface of the passage and the temperature at the outer surface of the glass melamine housing for the other electric fuse greatly exceeded 200°C. Moreover that chart showed that the glass melamine housing of the other electric fuse started to char or burn at a current level below the current level needed to cause that other electric fuse to open.

A slightly-different comparison was made between two further fuses like FIG. 8; but those fuses were cooled by ambient air which was moved over them at the rate of about nineteen and eight-tenths cubic meters per minute. Thermocouples were attached to the longitudinal centers of the outer surfaces of the housings of those further electric fuses, further thermocouples were attached to the inner surfaces of the passages in those housings, and additional thermocouples were attached to the terminals of those further electric fuses. The numbers and locations of those thermocouples are set forth in the following chart:

| Thermocouple Number | Location of Thermocouple |
|---|---|
| 1 | At inner surface of passage of aluminum oxide housing |
| 2 | Longitudinal center of outer surface of aluminum oxide housing |
| 3 | Terminal at one end of aluminum oxide housing |
| 4 | Terminal at other end of aluminum oxide housing |
| 5 | At inner surface of passage of glass melamine housing |
| 6 | Longitudinal center of outer surface of glass melamine housing |
| 7 | Terminal at one end of glass melamine housing |
| 8 | Terminal at other end of glass melamine housing. |

Those further electric fuses were connected in separate, but closely adjacent and similar, circuits, so those electric fuses would have the same environment but could be required to carry specifically-different values of current. An effort was made to set an initial value of current, for the electric fuse with the aluminum oxide housing, which would enable the temperature sensed by thermocouple 2 to stabilize in still air at 175° C.; and, similarly, an effort was made to set an initial value of current, for the electric fuse with the glass melamine housing, which would enable the temperature sensed by thermocouple 6 to stabilize in still air at one hundred and seventy-five degrees centigrade. As the following chart shows, the initial value of current for the electric fuse with the aluminum oxide housing caused the temperature sensed by thermocouple 2 in still air to stabilize at 175°C., but the initial value of current for the electric fuse with the glass melamine housing caused the temperature sensed by thermocouple 6 in still air to stabilize at 174°C. Further, that chart shows that although the initial current value and the initial temperature of the outer surface of the electric fuse with the aluminum oxide housing were higher than those of the electric fuse with the glass melamine housing, the latter electric fuse blew well prior to the blowing of the former electric fuse:

| Condition Of Air | Value of Current In Amperes Flowing Through Aluminum Oxide Housing Electric Fuse | Centigrade Temperature Sensed by Thermocouples | | | | Value of Current In Amperes Flowing Through Glass Melamine Housing Electric Fuse | Centigrade Temperature sensed By Thermocouples | | | |
|---|---|---|---|---|---|---|---|---|---|---|
| | | 1 | 2 | 3 | 4 | | 5 | 6 | 7 | 8 |
| Still | 66 | 261 | 175 | 174 | 175 | 54 | 432 | 174 | 121 | 122 |
| Moving | 60 | 95 | 50 | 50 | 49 | 54 | 333 | 59 | 52 | 52 |
| at about 19.8 c.m.m. | 63 | 118 | 62 | 62 | 63 | 57 | 394 | 67 | 58 | 59 |
| | 66 | 134 | 73 | 73 | 72 | 60 | 550 | 89 | 68 | 67 |
| | 69 | 161 | 77 | 78 | 78 | | Fuse blew eight minutes after current was raised to sixty amperes. | | | |
| | 72 | 183 | 86 | 86 | 86 | | | | | |
| | 75 | 205 | 95 | 94 | 95 | | | | | |
| | 78 | 222 | 105 | 106 | 105 | | | | | |
| | 81 | 252 | 115 | 116 | 116 | | | | | |
| | 84 | Fuse blew when current raised to 84 amperes | | | | | | | | |

The immediately-preceding chart shows that the electric fuse of FIG. 8 has a moving-air maximum continuous current carrying capacity of 81 amperes when it has an aluminum oxide housing, and has a moving-air maximum continuous current carrying capacity of only 57 amperes when it has a glass melamine housing. Further, that chart shows that the thermal conductivity of the aluminum oxide housing keeps the temperature at the inner surface of the passage in the electric fuse of FIG. 8 below 350°C. when that electric fuse is operated at its maximum continuous current carrying capacity, whereas the temperature at the inner surface of the passage in the electric fuse with the glass melamine housing is greater than 350°C. when that electric fuse is operated at its maximum continuous current carrying capacity. Also, that chart shows that the thermal conductivity of the aluminum oxide housing keeps the temperature at the inner surface of the passage in the electric fuse of FIG. 8 below 350°C. when the temperatures of the weak spots are caused by a prolonged low overload to reach 960°C, whereas the temperature at the inner surface of the passage in the electric fuse with the glass melamine housing is 550°C. when the temperatures of the weak spots are caused by a prolonged low overload to reach 960°C. In addition, that chart shows that the thermal conductivity of the aluminum oxide housing keeps the gradient between the temperature at the inner surface of the passage and the temperature at the outer surface of the housing less than 200°C. at all times, whereas the gradient between the temperature at the inner surface of the passage and the temperature at the outer surface of the glass melamine housing for the other electric fuse greatly exceeded 200°C. Moreover that chart shows that the temperature at the inner surface of the passage in the glass melamine housing of the other electric fuse greatly exceeded 149°C——the recommended upper limit for the temperature of Type G-5 glass melamine——at a current level below the current level needed to cause that other electric fuse to open.

The immediately-preceding chart further shows that the temperature at the inner surface of the passage in the other electric fuse exceeds 371°C——the recommended upper limit for the temperature of G-7 glass silicone——at a current level below the current level needed to cause that other electric fuse to open. As a result, that chart shows that prior fuses which utilized housings of glass melamine or of glass silicone did not operate, and could not have operated, as single-element, dual-function electric fuses if they utilized fusible elements of copper or silver. Hence that chart shows that such fuses did not operate, and could not have operated, as current-limiting, single-element, dual-function electric fuses.

The foregoing charts coact to show that the electric fuse of FIG. 8 has a still-air maximum continuous current carrying capacity which is more than one hundred and eighteen percent of the still-air maximum continuous current carrying capacity of the electric fuse which has the glass mealmine housing. They also coact to show that the electric fuse of FIG. 8 has a moving-air maximum continuous current carrying capacity which is more than 142 percent of the moving-air maximum continuous current carrying capacity of that other electric fuse.

Figure 10:
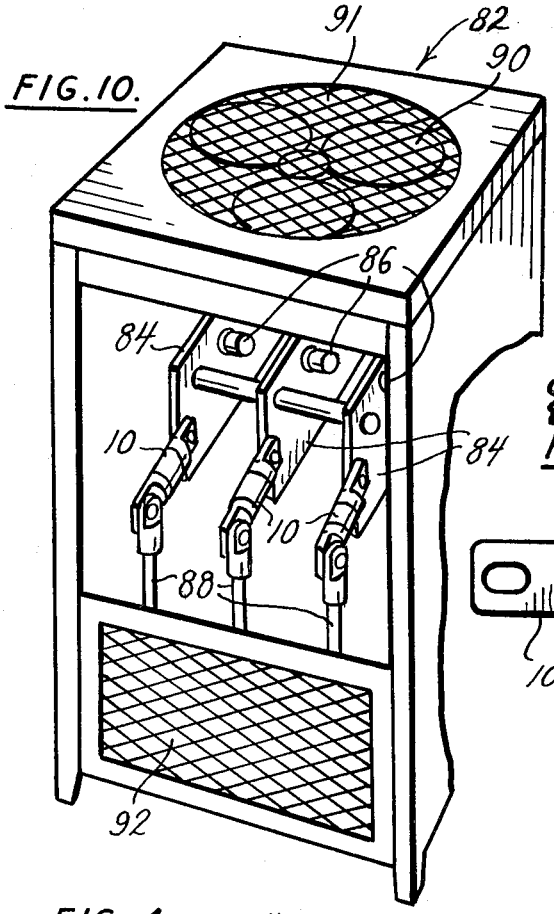
FIG. 10 is a perspective view of a housing which has the upper portion of one wall thereof removed to show the positioning of three electric fuses, of the type provided by the present invention, within an air stream provided by a fan.

Referring particularly to FIG. 10, the numeral 82 generally denotes a housing for a number of diodes 86. Those diodes are mounted on heat sinks 84 which are vertically-disposed, horizontally-extending, generally-rectangular metal plates. One of the electric fuses of FIG. 8 is connected to each of the heat sinks 84; and cables 88 are connected to the free ends of those electric fuses. The numeral 90 denotes a fan which is mounted adjacent the top of the housing 82; and that fuse is disposed immediately below an exhaust air grille 91 in that top. The numeral 92 denotes an intake air grille adjacent the bottom of one side of that housing. The upper portion of that side of the housing is an opaque plate; but that plate has been removed to permit a full showing of the electric fuses of FIG. 8 and of their connections to the heat sinks 84.

The heat sinks 84 serve as conductors as well as heat sinks; and the electric fuses are bolted directly to those heat sinks. The fan 90 will draw relatively-cool air inwardly through the intake air grille 92, will cause that air to pass over the diodes 86 and the electric fuses and the heat sinks 84, and will then cause that air to exit through the exhaust air grille 91. That air will flow at a rate in excess of nineteen and eight tenths cubic meters per minute. By providing such a flow of air, it is possible to make the values of current which can safely flow through those diodes and those electric fuses substantially greater than the values of current which can safely flow through those diodes and those electric fuses in a still-air atmosphere. Specifically, each of the fuses in FIG. 10 can continuously carry eighty-one amperes, but could continuously carry only 65 amperes in a still-air atmosphere. The fusible elements, of the electric fuses provided by the present invention, are made from a material, such as silver or copper, which has a melting temperature that is substantially higher than the melting temperature of lead or zinc. Consequently, the fusible elements of those electric fuses can be said to be made from a material having a high melting temperature.

The electric fuses provided by the present invention have only one fusible element in any given passage in any given housing. Moreover, the arc-extinguishing filler in each passage directly contacts the entire surface of the fusible element in that passage, and also directly contacts the inner surface of that passage. Also, the elongated sides of those fusible elements are close to that inner surface, and the weak spots in those fusible elements are closer to that inner surface than they are to the adjacent terminals. As a result, those electric fuses can radiate and conduct very appreciable amounts of heat from the weak spots thereof to the inner surfaces of the passages in the housings thereof. Further, those housings can radiate substantial amounts of the heat which is absorbed by the inner surface of the passages therein; and hence the electric fuses of the present invention can use fusible elements with weak spots of relatively-small cross section and yet act as single-element, dual-function electric fuses.

Each fusible element of each electric fuse provided by the present invention will have at least one weak spot therein, and many of those fusible elements will have more than one weak spot therein. It should be understood that unless the context of the specification or of a claim requires otherwise, the phrase weak spot is intended to refer to a weak spot which can respond to a low but potentially-harmful overload to fuse and which also can respond to a heavy overload or a short circuit to fuse. It should also be understood that if each fusible element of an electric fuse can respond to a low but potentially-harmful overload to fuse and also can respond to a heavy overload or a short circuit to fuse, that electric fuse is considered to be a single-element, dual-function electric fuse——whether it has only one fusible element or has a plurality of fusible elements.

The spacing between the edges of the fusible element 108 and the inner surface of the passage in the housing 100 helps determine the maximum continuous current carrying capacity of the electric fuse of FIG. 8. For example, a still further electric fuse was made so it was identical to the electric fuse of FIG. 8 except for the fact that the width of the fusible element 108 was increased from three hundred and eighteen thousandths of a centimeter to six hundred and thirty-five thousandths of a centimeter. The widths of the weak spots were left unchanged; but the spacing between each edge of the fusible element 108 and the adjacent portion of the inner surface of the passage in the housing 100 was reduced from one hundred and eighty-four thousandths of a centimeter to twenty-five thousandths of a centimeter. The maximum continuous current carrying capacity of that still further electric fuse was determined; and, for reading comparison, the results of that determination are set out hereinafter opposite the results of the determination of the continuous current carrying capacity of the electric fuse of FIG. 8. The numbers and locations of the thermocouples used in making those determinations are set forth in the following chart:

| Thermocouple Number | Location of Thermocouple |
|---|---|
| 1 | At inner surface of passage of housing of FIG. 8 |
| 2 | Longitudinal center of outer surface of housing of FIG. 8 |
| 3 | Terminal at one end of housing of FIG. 8 |
| 4 | Terminal at other end of housing of FIG. 8 |
| 5 | At inner surface of passage of housing of electric fuse of FIG. 8 with wider fusible element |
| 6 | Longitudinal center of outer surface |

-continued

| Thermocouple Number | Location of Thermocouple |
|---|---|
| | of housing of electric fuse of FIG. 8 with wider fusible element |
| 7 | Terminal at one end of housing of electric fuse of FIG. 8 with wider fusible element |
| 8 | Terminal at other end of housing of electric fuse of FIG. 8 with wider fusible element |

The two electric fuses were connected in separate, but closely adjacent and similar, circuits, so those electric fuses would have the same environment but could be required to carry specifically-different values of current. The initial value of current, for the electric fuse of FIG. 8, was set at a value which enabled the temperature sensed by thermocouple 2 to stabilize in still air at 175°C; and, similarly, the initial value of current, for the electric fuse of FIG. 8 with the wider fusible element was set at a value which enabled the temperature sensed by thermocouple 6 to stabilize in still air at 175°C.:

| Condition Of Air | Value of Current In Amperes Flowing Through Electric Fuse of FIG. 8 | Centigrade Temperature Sensed by Thermocouples | | | | Value of Current In Amperes Flowing Through Electric Fuse of FIG. 8 With Wider Fusible Element | Centigrade Temperature Sensed By Thermocouples | | | |
|---|---|---|---|---|---|---|---|---|---|---|
| | | 1 | 2 | 3 | 4 | | 5 | 6 | 7 | 8 |
| Still | 66 | 261 | 175 | 174 | 175 | 60 | 207 | 175 | 154 | 155 |
| Moving at about 19.8 c.m.m. | 60 | 95 | 50 | 50 | 49 | 60 | 111 | 71 | 65 | 66 |
| | 63 | 118 | 62 | 62 | 63 | 63 | 123 | 82 | 74 | 74 |
| | 66 | 134 | 73 | 73 | 72 | 66 | 137 | 84 | 74 | 76 |
| | 69 | 161 | 77 | 78 | 78 | 69 | 156 | 98 | 86 | 84 |
| | 72 | 183 | 86 | 86 | 86 | 72 | 178 | 109 | 94 | 95 |
| | 75 | 205 | 95 | 94 | 95 | 75 | 188 | 119 | 103 | 102 |
| | 78 | 222 | 105 | 106 | 105 | 78 | 218 | 139 | 118 | 118 |
| | 81 | 252 | 115 | 116 | 116 | 81 | 245 | 153 | 128 | 128 |
| | | Fuse blew when current raised to 84 amperes | | | | 83 | 276 | 172 | 145 | 145 |
| | | | | | | 86 | 317 | 187 | 166 | 166 |
| | | | | | | | Fuse blew when current raised to 89 amperes | | | |

The immediately-preceding chart shows that the positioning of the edges of the fusible element 108 closer to the inner surface of the passage in the housing 100 increased the continuous current carrying capacity of the electric fuse from 81 amperes to 86 amperes. Consequently, in the electric fuses of the present invention, it is preferable that the fusible elements of those electric fuses have widths in excess of 75 percent of the diameters of the passages in which they are disposed.

The fusible elements of the electric fuses provided by the present invention can have different configurations, different widths, and different thicknesses. Also, the passages in the housings of those electric fuses can have different cross-sectional configurations and different cross sections. However, no passage should have a diameter larger than one and twenty-seven hundredths of a centimeter; and, where that is the case, the maximum radial distance between any weak spot, of any fusible element lying on the geometric axis of that passage, and the inner surface of that passage will be less than sixty-four millimeters. Each weak spot should be spaced from each terminal a distance greater than 80 millimeters; and the inner surface of each passage should be as close to the elongated sides of the fusible element therein as assembly and economic requirements permit.

Whereas the drawing and accompanying description have shown and described several preferred embodiments of the present invention it should be apparent to those skilled in the art that various changes may be made in the form of the invention without affecting the scope thereof.

What I claim is:

1. A current-limiting electric fuse that comprises a housing which has an elongated passage therein, terminals which are located at the ends of said passage, a fusible element which is disposed within said passage and which is electrically connected to said terminals, said fusible element being essentially composed of copper or silver and having at least one weak spot therein, said fusible element responding to a prolonged low but potentially-harmful overload or to a short circuit or heavy overload to "open", and arc-extinguishing material which directly contacts said weak spot and the inner surface of said passage and which substantially fills said passage, said weak spot having at least one portion thereof which is displaced from said inner surface of said passage but said one portion being displaced from said inner surface by a distance less than 64 millimeters, said weak spot having said one portion thereof displaced from each of said terminals a distance greater than eighty millimeters, said housing being made from an inorganic ceramic material which has a thermal conductivity greater than thirty thousandths of a calorie per square centimeter of cross section per centimeter of length per second of time per degree centigrade, said housing having the major portion of the outer surface thereof exposed to a cooling medium to enable said major portion of said outer surface to radiate heat to said cooling medium, said weak spot generating heat whenever current flows through said fusible element, said arc-extinguishing material absorbing appreciable amounts of said heat from said weak spot and transferring most of said appreciable amounts of said heat to said inner surface of said passage, said housing transferring appreciable amounts of the heat which it receives from said arc-extinguishing material to said outer surface thereof to enable said outer surface to radiate heat to said cooling medium, said weak spot having a temperature in excess of 80 percent of the melting temperature of said fusible element whenever said electric fuse is operated at its maximum continuous current carrying capacity but said arc-extinguishing material and said housing transferring so much heat to said outer surface of said housing that the temperature of said inner surface of said passage remains below 350°C., said thermal conductivity of said inorganic ceramic material of said housing limiting the temperature gradient between said inner surface of said passage and said outer surface of said housing to less than 200°C., the temperature of said weak spot rising to the melting temperature of said fusible element whenever said fusible element responds to a prolonged low but potentially-harmful overload to open but said arc-extinguishing material and said housing transferring so much heat to said outer surface of said housing that the temperature of said inner surface of said passage remains below 350°C.

2. A current-limiting electric fuse that comprises a housing which has an elongated passage therein, terminals which are located at the ends of said passage, a fusible element which is disposed within said passage and which is electrically connected to said terminals, said fusible element being essentially composed of copper or silver and having at least one weak spot therein, said fusible element responding to a prolonged low but potentially-harmful overload or to a short circuit or heavy overload to open, and arc-extinguishing material which directly contacts said weak spot and the inner surface of said passage and which substantially fills said passage, said weak spot having at least one portion thereof which hs displaced from said inner surface of said passage but said one portion being displaced from said inner surface by a distance less than 64 millimeters, said weak spot having said one portion thereof displaced from each of said terminals a distance greater than eighty millimeters, said housing being made from an inorganic ceramic material which has a thermal conductivity greater than thirty thousandths of a calorie per square centimeter of cross section per centimeter of length per second of time per degree centigrade, said housing having the major portion of the outer surface thereof exposed to a cooling medium to enable said major portion of said outer surface to radiate heat to said cooling medium, said weak spot generating heat whenever current flows through said fusible element, said arc-extinguishing material absorbing appreciable amounts of heat and transferring most of said appreciable amounts of said heat to said inner surface of said passage, said housing transferring appreciable amounts of the heat which it receives from said arc-extinguishing material to said outer surface thereof to enable said outer surface to radiate heat to said cooling medium, said weak spot having a temperature in excess of 80 percent of its melting temperature whenever said electric fuse is operated at its maximum continuous current carrying capacity but said arc-extinguishing material and said housing transferring so much heat to said outer surface of said housing that the temperature of said inner surface of said passage remains below 350°C., the temperature of said weak spot rising to the melting temperature of said fusible element whenever said fusible element responds to a prolonged but potentially-harmful overload to open but said arc-extinguishing material and said housing transferring so much heat to said outer surface of said housing that the temperature of said inner surface of said passage remains below 350°C.

3. A current-limiting electric fuse that comprises a housing which has an elongated passage therein, terminals which are located at the ends of said passage, a fusible element which is disposed within said passage and which is electrically connected to said terminals, said fusible element being essentially composed of copper or silver and having at least one weak spot therein, said fusible element responding to a prolonged low but potentially-harmful overload or to a short circuit or heavy overload to open, and arc-extinguishing material which directly contacts said weak spot and the inner surface of said passage and which substantially fills said passage, said weak spot having at least one portion thereof which is displaced from said inner surface of said passage but said one portion being displaced from said inner surface by a distance less than 64 millimeters, said weak spot having said one portion thereof displaced from each of said terminals a distance greater than 80 millimeters, said housing being made from an inorganic ceramic material which has a thermal conductivity greater than thirty thousandths of a calorie per square centimeter of cross section per centimeter of length per second of time per degree centigrade, said housing having the major portion of the outer surface thereof exposed to a cooling medium to enable said major portion of said outer surface to radiate heat to said cooling medium, said weak spot generating heat whenever current flows through said fusible element, said arc-extinguishing material absorbing appreciable amounts of heat and transferring most of said appreciable amounts of said heat to said inner surface of said passage, said housing transferring appreciable amounts of the heat which it receives from said arc-extinguishing material to said outer surface thereof to enable said outer surface to radiate heat to said cooling medium, said weak spot having a temperature in excess of eighty percent of its melting temperature whenever said electric fuse is operated at its maximum continuous current carrying capacity but said arc-extinguishing material and said housing transferring so much heat to said outer surface of said housing that the temperature of said inner surface of said passage remains below 350°C., the temperature of said weak spot rising to the melting temperature of said fusible element whenever said fusible element responds to a prolonged but potentially-harmful overload to open but said arc-extinguishing material and said housing transferring so much heat to said outer surface of said housing that the temperature of said inner surface of said passage remains below 350°C., said fusible element being the only fusible element within said passage, and the width of said fusible element being greater than seventy-five percent of the diameter of said passage.

4. A current-limiting electric fuse that comprises a housing which has an elongated passage therein, terminals which are located at the ends of said passage, a fusible element which is disposed within said passage and which is electrically connected to said terminals, said fusible element being essentially composed of copper or silver and having at least onen weak spot therein, and arc-extinguishing material which directly contacts said weak spot and the inner surface of said passage and which substantially fills said passage, said housing being made from an inorganic ceramic material which has a thermal conductivity greater than thirty thousandths of a calorie per square centimeter of cross section per centimeter of length per second of time per degree centigrade, said housing having the major portion of the outer surface thereof exposed to a cooling medium to enable said major portion of said outer surface to radiate heat to said cooling medium, said weak spot generating heat whenever current flows through said fusible element, said arc-extinguishing material absorbing appreciable amounts of said heat from said weak spot and transferring most of said appreciable amounts of said heat to said inner surface of said passage, said housing transferring appreciable amounts of the heat which it receives from said arc-extinguishing material to said outer surface thereof to enable said outer surface to radiate heat to said cooling medium, said weak spot having a temperature in excess of eighty percent of its melting temperature whenever said electric fuse is operated at its maximum continuous current carrying capacity but said arc-extinguishing material and said housing transferring so much heat to said outer surface of said housing that the temperature of said inner surface of said passage remains below 350°C., the temperature of said weak spot rising to the melting temperature of said fusible element whenever said fusible element responds to a low but potentially-harmful overload to open but said arc-extinguishing material and said housing transferring so much heat to said outer surface of said housing that the temperature of said inner surface of said passage remains below 350°C.

5. A current-limiting electric fuse that comprises a housing which has an elongated passage therein, terminals which are located at the ends of said passage, a fusible element which is disposed within said passage and which is electrically connected to said terminals, said fusible element being essentially composed of copper or silver and having at least one weak spot therein, and arc-extinguishing material which directly contacts said weak spot and the inner surface of said passage and which substantially fills said passage, said weak spot having at least one portion thereof which is displaced from said inner surface of said passage but said one portion being displaced from said inner surface by a distance less than 64 millimeters, said housing being made from an inorganic ceramic material which has a thermal conductivity greater than thirty thousandths of a calorie per square centimeter of cross section per centimeter of length per second of time per degree centigrade, said housing having the major portion of the outer surface thereof exposed to a cooling medium to enable said major portion of said outer surface to radiate heat to said cooling medium, said weak spot generating heat whenever current flows through said fusible element, said arc-extinguishing material absorbing appreciable amounts of said heat from said weak spot and transferring most of said appreciable amounts of said heat to said inner surface of said passage, said housing transferring appreciable amounts of the heat which it receives from said arc-extinguishing material to said outer surface thereof to enable said outer surface to radiate heat to said cooling medium, said weak spot having a temperature in excess of 80 percent of its melting temperature whenever said electric fuse is operated at its maximum continuous current-carrying capacity but said arc-extinguishing material and said housing transferring so much heat to said outer surface of said housing that the temperature of said inner surface of said passage remains below 350°C., the temperature of said weak spot rising to the melting temperature of said fusible element whenever said fusible element responds to a prolonged low but potentially-harmful overload to open but said arc-extinguishing material and said housing transferring so much heat to said outer surface of said housing that the temperature of said inner surface of said passage remains below 350°C.

6. A current-limiting electric fuse that comprises a housing which has an elongated passage therein, terminals which are located at the ends of said passage, a fusible element which is disposed within said passage and which is electrically connected to said terminals, said fusible element being essentially composed of copper or silver and having at least one weak spot therein, and arc-extinguishing material which directly contacts said weak spot and the inner surface of said passage and which substantially fills said passage, said housing being made from an inorganic ceramic material which has a thermal conductivity greater than thirty thousandths of a calorie per square centimeter of cross section per centimeter of length per second of time per degree centigrade, said housing having the major portion of the outer surface thereof exposed to a cooling medium to enable said major portion of said outer surface to radiate heat to said cooling medium, said weak spot generating heat whenever current flows through said fusible element, said arc-extinguishing material absorbing appreciable amounts of said heat from said weak spot and transferring most of said appreciable amounts of said heat to said inner surface of said passage, said housing transferring appreciable amounts of the heat which it receives from said arc-extinguishing material to said outer surface thereof to enable said outer surface to radiate heat to said cooling medium, the temperature of said weak spot rising to the melting temperature of said fusible element whenever said fusible element responds to a prolonged low but potentially-harmful overload to open but said arc-extinguishing material and said housing transferring so much heat to said outer surface of said passage that the temperature of said inner surface of said passage remains below 350°C.

7. A current-limiting, single-element, dual-function, electric fuse that comprises a housing which has an elongated passage therein, terminals which are located at the ends of said passage, a fusible element which is disposed within said passage and which is electrically connected to said terminals, said fusible element being essentially composed of copper or silver and having at least one weak spot therein, said fusible element responding to a prolonged low but potentially-harmful overload or to a short circuit or heavy overload to open, arc-extinguishing material within said passage, said weak spot having at least one portion thereof which is displaced from said inner surface of said passage but said one portion being displaced from said inner surface by a distance less than sixty-four millimeters, said weak spot having said one portion thereof displaced from each of said terminals a distance greater than 80 millimeters, said housing being made from an inorganic ceramic material which has a thermal conductivity greater than thirty thousandths of a calorie per square centimeter of cross section per centimeter of length per second of time per degree centigrade, and means to move a cooling medium into engagement with said outer surface of said housing to absorb heat from said outer surface, said means forcing said cooling medium to move into engagement with said outer surface of said housing to absorb heat from said outer surface throughout the time said current-limiting, single-element, dual-function, electric fuse is carrying current, said housing having the major portion of the outer surface thereof exposed to said cooling medium to enable said major portion of said outer surface to transfer heat to said cooling medium, said weak spot generating heat whenever current flows through said fusible element, said arc-extinguishing material absorbing appreciable amounts of said heat and transferring most of said appreciable amounts of said heat to said inner surface of said passage, said housing transferring appreciable amounts of the heat which it receives from said arc-extinguishing material to said outer surface thereof to enable said outer surface to transfer heat to said cooling medium, said weak spot having a temperature in excess of 80 percent of the melting temperature of said fusible element whenever said electric fuse is operated at its maximum continuous current carrying capacity.

8. A current-limiting single-element, dual-function, electric fuse that comprises a housing which has an elongated passage therein, terminals which are located at the ends of said passage, a fusible element which is disposed within said passage and which is electrically connected to said terminals, said fusible element being essentially composed of copper or silver and having at least one weak spot therein, said fusible element responding to a prolonged low but potentially-harmful overload or to a short circuit or heavy overload to open, arc-extinguishing material within said passage, said weak spot having at least one portion thereof which is displaced from said inner surface of said passage but said one portion being displaced from said inner surface by a distance less than 64 millimeters, said weak spot having said one portion thereof displaced from each of said terminals a distance greater than eighty millimeters, said housing being made from an inorganic ceramic material which has a thermal conductivity greater than thirty thousandths of a calorie per square centimeter of cross section per centimeter of length per second of time per degree centigrade, and means to move a cooling medium into engagement with said outer surface of said housing to absorb heat from said outer surface, said means forcing said cooling medium to move into engagement with said outer surface of said housing to absorb heat from said outer surface throughout the time said current-limiting single-element, dual-function, electric fuse is carrying current, said housing having the major portion of the outer surface thereof exposed to said cooling medium to enable said major portion of said outer surface to transfer heat to said cooling medium, said weak spot generating heat whenever current flows through said fusible element, said arc-extinguishing material absorbing appreciable amounts of said heat and transferring most of said appreciable amounts of said heat to said inner surface of said passage, said housing transferring appreciable amounts of the heat which it receives from said arc-extinguishing material to said outer surface thereof to enable said outer surface to transfer heat to said cooling medium, said weak spot having a temperature in excess of eighty percent of the melting temperature of said fusible element whenever said electric fuse is operated at its maximum continuous current carrying capacity, said thermal conductivity of said inorganic ceramic material of said housing limiting the temperature gradient between said inner and outer surfaces of said housing to less than 200°C.

9. A current-limiting single-element, dual-function, electric fuse as claimed in claim 7 wherein the temperature of said weak spot rises to the melting temperature of said fusible element whenever said fusible element responds to a prolonged low but potentially-harmful overload to open but wherein said arc-extinguishing material and said housing transfer so much heat to said outer surface of said housing that the temperature of said inner surface of said passage remains below 350°C.

10. A current-limiting single-element, dual-function, electric fuse as claimed in claim 7 wherein said arc-extinguishing material directly contacts said weak spot and said inner surface of said passage, wherein said arc-extinguishing material substantially fills said passage, and wherein said arc-extinguishing material and said housing transfer so much heat to said outer surface of said housing that the temperature of said inner surface of said passage remains below 350°C.

11. A current-limiting single-element, dual-function, electric fuse as claimed in claim 7 wherein said arc-extinguishing material directly contacts said weak spot and said inner surface of said passage, wherein said arc-extinguishing material substantially fills said passage, wherein said arc-extinguishing material and said housing transfer so much heat to said outer surface of said housing that the temperature of said inner surface of said passage remains below 350°C., and wherein said thermal conductivity of said inorganic ceramic material of said housing limits the temperature gradient between said inner and outer surfaces of said housing to less than 200°C.

12. A current-limiting single-element, dual-function, electric fuse as claimed in claim 7 wherein said cooling medium is continuously forced to move into engagement with said outer surface of said housing to absorb heat from said outer surface.

13. A current-limiting, single-element, dual-function, electric fuse that comprises a housing which has an elongated passage therein, terminals which are located at the ends of said passage, a fusible element which is disposed within said passage and which is electrically connected to said terminals, said fusible element being made from a material which has a high melting temperature, said fusible element responding to a prolonged low but potentially-harmful overload or to a short circuit or heavy overload to open, and arc-extinguishing material within said passage, said housing being made from an inorganic ceramic material which has a thermal conductivity greater than thirty thousandths of a calorie per square centimeter of cross section per centimeter of length per second of time per degree centigrade, said housing having the major portion of the outer surface thereof exposed to a cooling medium to enable said major portion of said outer surface to radiate heat to said cooling medium, said fusible element generating heat whenever current flows through said electric fuse, said arc-extinguishing material absorbing appreciable amounts of said heat and transferring most of said appreciable amounts of said heat to said inner surface of said passage, said housing transferring appreciable amounts of the heat which it receives from said arc-extinguishing material to said outer surface thereof to enable said outer surface to radiate heat to said cooling medium, at least one portion of said fusible element having a temperature in excess of eighty percent of the melting temperature of the material of said fusible element whenever said electric fuse is operating at its maximum continuous current carrying capacity.

14. A current-limiting, single-element, dual-function electric fuse as claimed in claim 13 wherein said thermal conductivity of said inorganic ceramic material of said housing limits the temperature gradient between said inner and outer surfaces of said housing to less than 200°C.

15. A current-limiting, single-element, dual-function electric fuse as claimed in claim 13 wherein the temperature of said weak spot rises to the melting temperature of said fusible element whenever said fusible element responds to a prolonged low but potentially-harmful overload to open, but wherein said arc-extinguishing material and said housing transfer so much heat to said outer surface of said housing that the temperature of said inner surface of said passage remains below 350°C.

16. A current-limiting, single-element, dual-function electric fuse as claimed in claim 13 wherein said arc-extinguishing material directly contacts said weak spot and said inner surface of said passage, wherein said arc-extinguishing material substantially fills said passage, and wherein said arc-extinguishing material and said housing transfer so much heat to said outer surface of said housing that the temperature of said inner surface of said passage remains below 350°C.

17. A current-limiting, single-element, dual-function electric fuse as claimed in claim 13 wherein said arc-extinguishing material directly contacts said weak spot and said inner surface of said passage, wherein said arc-extinguishing material substantially fills said passage, wherein said arc-extinguishing material and said housing transfer so much heat to said outer surface of said housing that the temperature of said inner surface of said passage remains below 350°C., and wherein said thermal conductivity of said inorganic ceramic material of said housing limits the temperature gradient between said inner and outer surfaces of said housing to less than two hundred degrees centigrade.

18. A current-limiting, single-element, dual-function electric fuse as claimed in claim 13 wherein means moves a cooling medium into engagement with said outer surface of said housing to absorb heat from said outer surface, and wherein said means forces said cooling medium to continuously move into engagement with said outer surface of said housing to absorb heat from said outer surface throughout the time said current-limiting, single-element, dual-function, electric fuse is carrying current.

19. A current-limiting, single-element, dual-function, electric fuse that comprises a housing which has an elongated passage therein, terminals which are located at the ends of said passage, a fusible element which is disposed within said passage and which is electrically connected to said terminals, said fusible element being essentially composed of copper or silver and having at least one weak spot therein, said fusible element responding to a prolonged low but potentially-harmful overload or to a short circuit or heavy overload to open, and arc-extinguishing material which directly contacts said weak spot and the inner surface of said passage and which substantially fills said passage, said weak spot being displaced from said inner surface of said passage and also being displaced from both of said terminals, said weak spot being displaced from said inner surface by a distance smaller than the distance by which said weak spot is displaced from each of said terminals, said housing being made from an inorganic ceramic material which has a thermal conductivity greater than thirty thousandths of a calorie per square centimeter of cross section per centimeter of length per second of time per degree centigrade, said housing having the major portion of the outer surface thereof exposed to a cooling medium to enable said major portion of said outer surface to radiate heat to said cooling medium, said weak spot generating heat whenever current flows through said fusible element, said arc-extinguishing material absorbing appreciable amounts of heat and transferring most of said appreciable amounts of said heat to said inner surface of said passage, said housing transferring appreciable amounts of the heat which it receives from said arc-extinguishing material to said outer surface thereof to enable said outer surface to radiate heat to said cooling medium.

20. A current-limiting, single-element, dual-function, electric fuse as claimed in claim 19 wherein said thermal conductivity of said inorganic ceramic material of said housing limits the temperature gradient between said inner surface of said passage and said outer surface of said housing to less than 200°C.

21. A current-limiting, single-element, dual-function, electric fuse as claimed in claim 19 wherein said thermal conductivity of said inorganic ceramic material of said housing keeps the temperature at said inner surface of said passage from reaching 350°C.

22. A current-limiting, single-element, dual-function, electric fuse as claimed in claim 19 wherein said weak spot has a temperature in excess of 80 percent of the melting temperature of said fusible element whenever said electric fuse is operated at its maximum continuous current carrying capacity.

23. A current-limiting, single-element, dual-function, electric fuse as claimed in claim 19 wherein said fusible element is the only circuit-interrupting element within said passage.

24. A current-limiting, single-element, dual-function, electric fuse as claimed in claim 19 wherein the width of said fusible element is greater than 75 percent of the diameter of said passage.

* * * * *